US006739264B1

(12) United States Patent
Hosey et al.

(10) Patent No.: US 6,739,264 B1
(45) Date of Patent: May 25, 2004

(54) LOW COST IGNITION DEVICE FOR GAS GENERATORS

(75) Inventors: Edward O. Hosey, Lakeland, FL (US); Keith Lam, Lakeland, FL (US)

(73) Assignee: Key Safety Systems, Inc., Sterling Heights, MI (US)

( * ) Notice: Subject to any disclaimer, the term of this patent is extended or adjusted under 35 U.S.C. 154(b) by 0 days.

(21) Appl. No.: 10/286,799

(22) Filed: Nov. 4, 2002

(51) Int. Cl.[7] ..... F42C 19/12

(52) U.S. Cl. ..... 102/202.9; 102/202.3; 102/202.7; 102/202.2; 280/741

(58) Field of Search ..... 102/202.1, 202.3, 102/202.5, 202.7, 202.9, 202.14, 530, 531; 280/741; 86/1.1

(56) References Cited

U.S. PATENT DOCUMENTS

| | | | | |
|---|---|---|---|---|
| 4,730,558 A | | 3/1988 | Florin et al. | 102/218 |
| 5,099,762 A | * | 3/1992 | Drapala | 102/202.1 |
| 5,125,335 A | * | 6/1992 | Grommes et al. | 102/202.13 |
| 5,179,248 A | * | 1/1993 | Hartman et al. | 102/202.4 |
| 5,309,841 A | * | 5/1994 | Hartman et al. | 102/202.4 |
| 5,394,801 A | * | 3/1995 | Faber et al. | 102/202.7 |
| 5,634,660 A | * | 6/1997 | Fink et al. | 280/741 |
| 5,763,814 A | * | 6/1998 | Avory et al. | 102/202.7 |
| 5,955,699 A | * | 9/1999 | Perotto et al. | 102/530 |
| 6,085,659 A | | 7/2000 | Beukes et al. | 102/206 |
| 6,166,452 A | | 12/2000 | Adams et al. | 307/10.1 |
| 6,220,163 B1 | * | 4/2001 | Duguet et al. | 102/202.2 |
| 6,220,165 B1 | | 4/2001 | Sullivan | 102/206 |
| 6,272,965 B1 | | 8/2001 | Baginski et al. | 102/202.1 |
| 6,302,023 B1 | | 10/2001 | Wier | 102/202.2 |
| 6,324,979 B1 | | 12/2001 | Troianello | 102/202.7 |
| 6,341,562 B1 | | 1/2002 | Brisighella | 102/202.14 |
| 6,389,972 B2 | * | 5/2002 | Duvacquier et al. | 102/202.2 |
| 6,418,853 B1 | | 7/2002 | Duguet et al. | 102/202.2 |
| 6,553,914 B2 | * | 4/2003 | Hosey et al. | 102/530 |
| 2002/0007756 A1 | | 1/2002 | Bornheim et al. | 102/530 |

OTHER PUBLICATIONS

Pyrotechnic device manufactured by Diemen S.A, (2 photocopies of photographs) admitted prior art.

Pyrotechnic Bridge with Delonation Path Through a Circuit Board—U.S. Application No. 10/426,656.

* cited by examiner

*Primary Examiner*—Michael J. Carone
*Assistant Examiner*—James S. Bergin
(74) *Attorney, Agent, or Firm*—Lonnie Drayer; Patrick Steinnon

(57) ABSTRACT

An initiator has a circuit board with two spaced copper traces and a bridge resistor of Nichrome® or tantalum nitride at one end, and wire leads or pins joining the wire traces at the other end. A zener diode is placed between the wire leads and a bridge resistor. Immediately before the wire leads reach the circuit board they pass through a ferrite core. The wire leads, the ferrite core, and the circuit board except for the end of the board to which the bridge resistor is mounted, is insert molded into a body of glass filled nylon 6,6. The nylon body mounts an aluminum can that covers the bridge resistor and is bonded to a circumferential groove in the nylon body. The bridge resistor is covered with primary explosives such as zirconium potassium perchlorate and the can is filled with gas generating granules such as 5-aminotetrazole.

14 Claims, 3 Drawing Sheets

LOW COST IGNITION DEVICE FOR GAS GENERATORS

FIELD OF THE INVENTION

The present invention relates to initiators and detonators generally and to hot-wire initiators in particular.

BACKGROUND OF THE INVENTION

The modem automobile requires many electronic initiators for activating various safety systems. Most well known are airbags of various types, but other devices requiring an initiator include seatbelt tensioners and hood elevators used to reduce pedestrian fatalities. Because some fifteen to twenty million vehicles are sold each year in the United States, and each vehicle may have many initiators, the total number of ignition devices for gas generators may soon be in the hundreds of millions per year. High reliability, low cost and minimal environmental contamination are also important consideration for these devices. Environmental contamination caused by toxic-metal-based primary explosives is of particular concern, even though the quantities used in a single detonator are minute. The gases produced by the initiation charge can be introduced into the passenger compartment where respiration by the passengers provides at least a theoretical concern for toxic metal exposure. A growing sensitivity to possible toxic metal contamination has also resulted in regulations forever more tightly controlling the use of toxic metals compounds such as those containing lead and mercury.

What is needed is an initiator for gas generators which is of low cost, reliable, and constructed without toxic metals compounds.

SUMMARY OF THE INVENTION

The initiator of this invention comprises a circuit board having two copper traces and a bridge resistor of Nichrome® or tantalum nitride mounted across the copper traces at one end of the board. A gap in the circuit board is formed between the copper traces where the resistor is positioned. At the other end of the circuit board wire leads or pins are joined to the wire traces. A zener diode is placed between the wire leads and a bridge resistor. The zener diode functions as a short across the copper traces when they apply a voltage above the all-fire voltage by more than a selected amount, such as results when a static electrical charge is applied to the wire leads. Immediately before the wire leads reach the circuit board they are passed through a ferrite core which serves to block high frequency signals which might cause premature ignition or detonation. The wire leads, the ferrite core, and the circuit board, excluding the end of the board to which the bridge resistor is mounted, is insert molded into a body of glass filled nylon 6,6. The nylon body, which is generally cylindrical in shape, mounts to a cylindrical soft aluminum can, which covers the bridge resistor. The aluminum can is bonded to a circumferential groove formed in the nylon body. The bond forms a hermetic seal between the aluminum can and the nylon body. Before the aluminum can is bonded in place the bridge resistor is covered with a primary explosive which is free of lead and mercury such as zirconium potassium perchlorate and the can is filled with gas generating granules such as 5-aminotetrazole. The gas generator granules do not need to be in direct contact with the initiation charge although they may be depending on the orientation of the initiator. The initiator is of the hot-wire type characterized by a rapid burning or deflagrating. This is in contrast to initiators that trigger an explosive with a supersonic detonation wave.

It is a feature of the present invention to provide an initiator of lower-cost.

It is another feature of the present invention to provide an initiator which does not contain toxic metals compounds.

It is a further feature of the present invention to provide an initiator which is protected against radio frequency and electrostatic discharge.

Further features and advantages of the invention will be apparent from the following detailed description when taken in conjunction with the accompanying drawings.

DETAILED DESCRIPTION OF THE INVENTION

Figure 1:
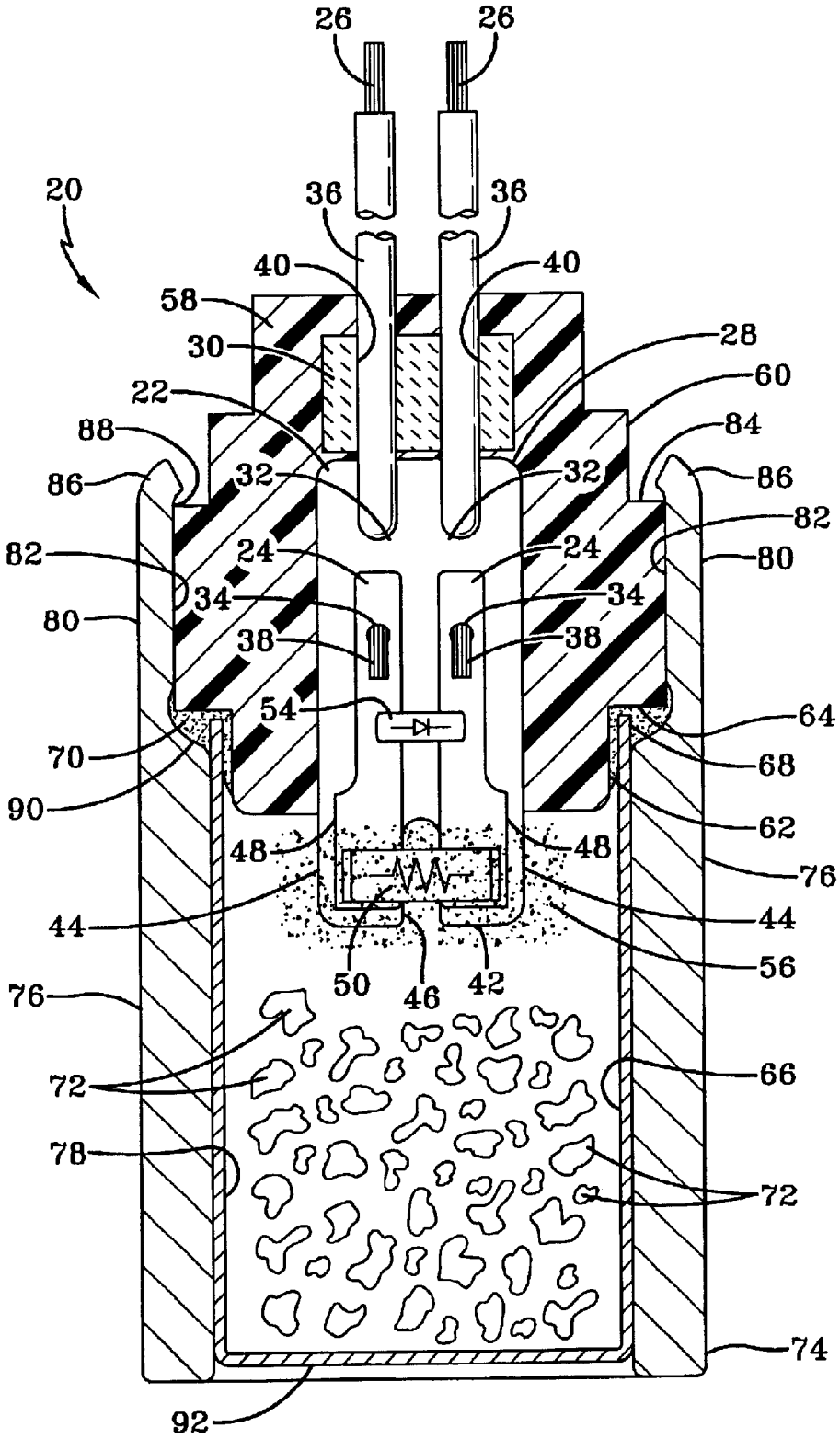
FIG. 1 is a cross-sectional front elevational view of the initiator of the invention, shown installed within a fixture in an automobile.
Figure 2:
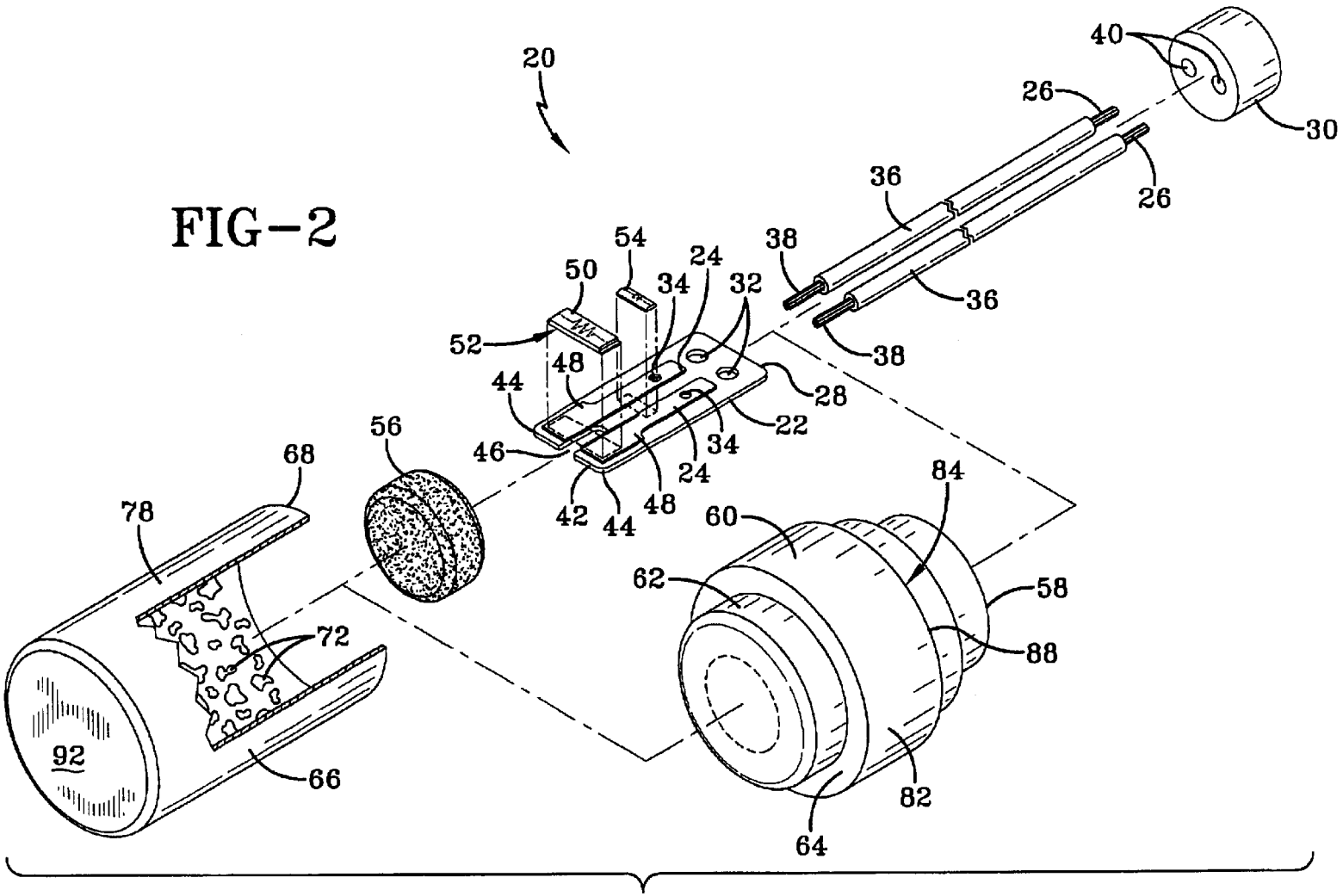
FIG. 2 is an exploded isometric view of the initiator of FIG. 1.
Figure 3:
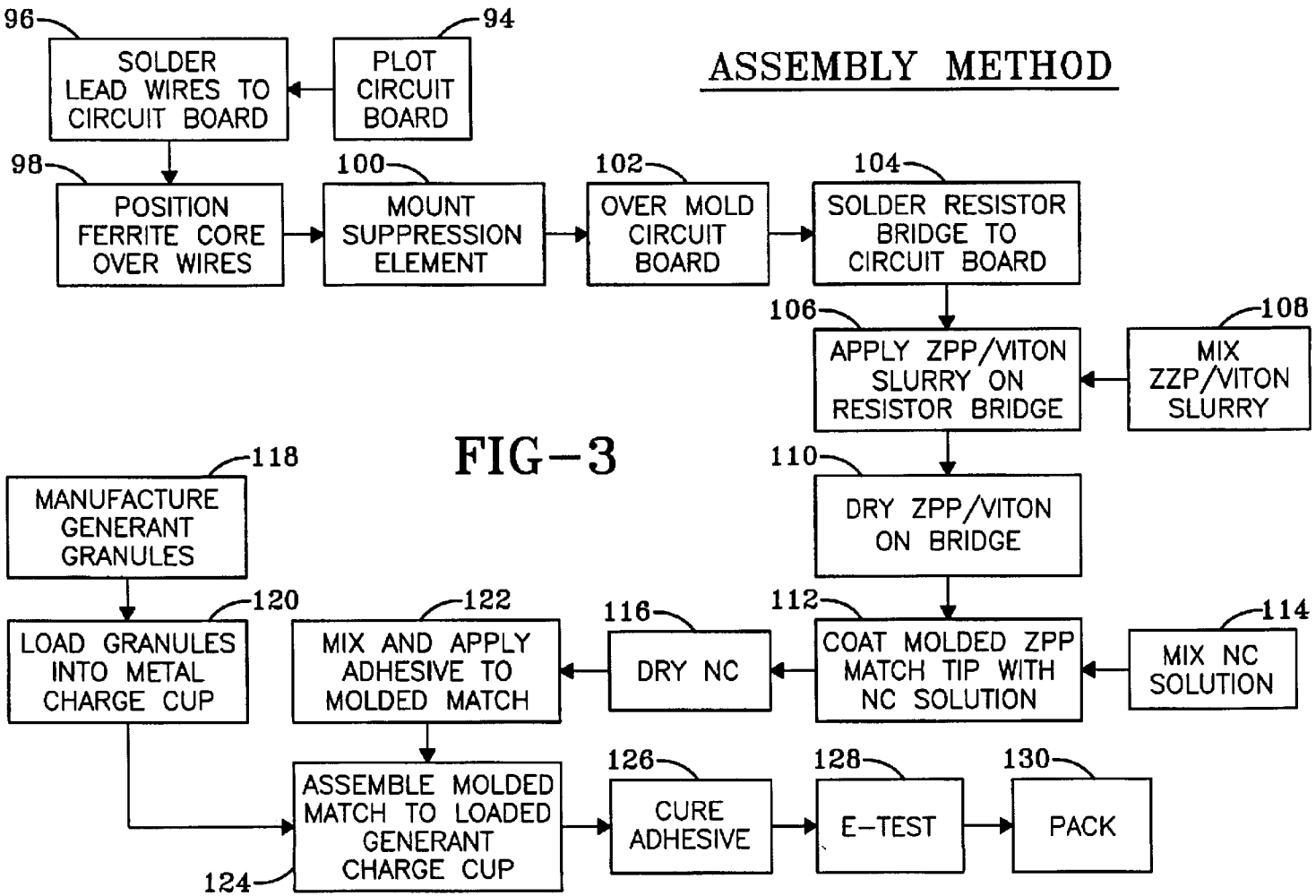
FIG. 3 is a flow diagram of the assembly method of the initiator of FIG. 1.

Referring more particularly to FIGS. 1–3, wherein like numbers refer to similar parts, an initiator 20 is shown in FIG. 1. The initiator 20 has a rectangular circuit board 22 on which two copper traces 24 are positioned. Wires 26 are connected to each of the copper traces 24 at a first end 28 of the circuit board 22. The wires 26 pass through a holes 40 in a ferrite core 30 before being joined to the circuit board 22, and then extend downwardly through holes 32 in the circuit board which are positioned before the beginning of the copper traces 24 as shown in FIGS, 1 and 2. Then the wires pass upwardly through holes 34 in the circuit board 22 that also pass through the copper traces 24. The wires 26 have coatings 36 that cover the wires 26. Stripped portions 38 of the wires 26 extend upwardly through the holes 34. The stripped portions 38 are soldered to the copper traces 24 by a reflow solder process.

The ferrite core 30 is constructed as one piece with the two holes 40 which receive the wires 26. The ferrite core 30 is positioned adjacent to the first end 28 of the circuit board 22. The inductance of the ferrite core 30 resists the transmission of high frequency voltages such as are produced by electromagnetic interference. The wires 26 and the copper traces 24 form conductive means which extend through a plastic plug 58.

The circuit board 22 has a second or hot-wire end 42 that is divided into two parts 44 by a slot 46 between the two copper traces 24. The copper traces 24 form enlarged solder pads 48 on either side of the slot 46. A bridge resistor 50 consisting of a surface deposited tantalum nitride or Nichrome® trace is mounted between the solder pads 48 of the copper trade traces 24. The bridge resistor will preferably be mounted with the surface 52 on which the resistor is formed facing the solder pads 48. This mounting position facilitates reflow solder or wave solder mounting of the bridge resistor, and is the reason for the slot 46 which allows an initiation charge 56 to be brought into contact with the surface 52 on which the resistor 50 is formed. For illustrative purposes, the resistor 50 is shown in FIGS. 1 and 2 as facing away from the board 22 but will preferably face the board as explained above.

A zener diode 54 is mounted across the copper traces 24 positioned between the bridge resistor 50 and of the stripped portions 38 of the wires 26 that are soldered to the copper traces 24. The zener diode 54 is selected to conduct in the forward direction at the voltage that slightly exceeds the forward all-fire voltage necessary to activate the initiation compound or charge 56. In the back direction the zener diode conducts with a very small applied voltage. In this way the zener diode prevents initiation of the igniter by any voltage which is not of the right polarity, and by any voltage which exceeds the forward all-fire voltage. Any alternating voltage is limited to about one-half of the all-fire voltage because the zener diode 54 acts as a short for most of one-half of the cycle of an alternating applied voltage. The zener diode thus forms a means for suppressing high-voltage currents that are applied to the wires 26.

The circuit board 22, the ferrite core 30, and the wire portions 38 are contained within a glass filled nylon 6,6 plug 58. The nylon plug 58 is formed by insert molding, i.e., the ferrite core and the circuit board are placed in an injection mold and the nylon is injected into a cavity surrounding the core and circuit board. The nylon plug 58 has an external surface 60 which includes a first cylindrical surface 62 which abuts a first radial surface 64. A can 66 is constructed of a dead soft, thin gauge, low alloy aluminum. The aluminum can 66 has an upper peripheral edge 68 that substantially abuts the first radial surface 64. The aluminum can 66 is bonded to the first cylindrical surface 62 by a quantity of adhesive 70 which may be, for example, a two-part PolyAmid epoxy available from Lord Corporation of Indianapolis, Ind., U.S.A. through its subsidiary Thermoset, the epoxy resin having part number WHJ-03-240-A and the epoxy catalyst having part number WHJ-03-148-B. The aluminum can contains a quantity of gas generant 72 such as 5-aminotetrazole.

The initiator 20 is typically mounted to an airbag housing (not shown) or other gas activated device by being crimped within a fixture 74 as shown in FIG. 1. The fixture 74 may be part of an airbag housing or other safety system and has portions 76 that closely overlie and support the cylindrical wall 78 of the aluminum can 66. The fixture 74 also has a cylindrical portion 80 which extends along a second cylindrical surface 82 of the nylon plug 58 and which extends between the first radial surface 64 and a second radial surface 84 substantially parallel to and spaced from the first radial surface 64. The fixture cylindrical portion 80 has a lip 86 which is crimped inwardly over a circular edge 88 formed between the second cylindrical surface 82 and the second radial surface 84. The nylon plug 58 is fixed with respect to the fixture 74 by the lip 86 and an inwardly facing circular step 90 in the fixture portions 76. The aluminum can 66 has a circular bottom 92 which is not contained by the fixture 74 and allows gases generated by the gas generant granules 72 to exit the can 66 by bursting the circular bottom 92.

The initiator 20 is constructed in accordance with the block diagram shown in FIG. 3. First the circuit board is designed and constructed 94, then the wires 26 are soldered 96 to the circuit board, and the ferrite core 30 is positioned 98 over the wires 26. Alternatively, the ferrite core may be prepositioned on the wires 26 and slid into position after the wires are soldered to the circuit board. An electrostatic discharge suppression device such as a zener diode 54, is mounted 100 to the circuit board 22 across the copper traces 24 by reflow soldering techniques which can also be used to solder the wires 26 to the circuit board traces. The circuit board with the suppression device 54 and the wires 26 mounted thereto, together with the ferrite core 30 which is positioned adjacent the first end 28 of the circuit board, is positioned in a mold 102 which is filled with glass filled nylon 6,6 to form the plug 58. The plug 58 may consist of approximately 30 percent by weight of glass fibers contained in the nylon forming the plug.

The bridge resistor 50 is then mounted 104 by the reflow solder technique across the slot 46 to the enlarged solder pads 48 which connect to the copper traces 24. The bridge resistor 50 is mounted with the nichrome or tantalum nitride resistor facing the solder pads 48.

The bridge resistor 50 is coated 106 with a mixture 108 of zirconium potassium perchlorate, and one to three percent by weight with Viton® elastomer. The mixture is dissolved in a solvent such as Methylisobutylketone to form a suitably viscous liquid so that when the bridge resistor 50 is dipped into the liquid, a suitably thick layer of zirconium potassium perchlorate (ZPP) is formed over the resistor. The ZPPI Viton® mixture is allowed to dry 110 to form the initiation charge 56. The initiation charge or compound 56 is over coated 112 with a mixture 114 of nitrocellulose dissolved in a solvent e.g., ethyl acetate, to form a low viscosity varnish which is resistant to moisture. The nitrocellulose layer is then dried 116. The gas generating granules 118 are loaded 120 into the aluminum can 66. The adhesive is applied 122 to the first cylindrical surface 62 and the loaded aluminum can 66 is assembled 124 to the plug 58. The adhesive is cured 126, the initiator is electrically tested 128 and packaged 130 for shipping.

It should be understood that the initiator 20 may be used to initiate a gas generator cartridge which, for example, inflates an airbag, or may directly generate sufficient gas to drive various gas operated mechanisms such as a seatbelt retractor or the like.

It should be understood that suppression elements other than a zener diode 54 could be used, for example a spark gap discharge could be used.

It should be understood that the aluminum can may be crimped with an O-ring, or other elastomeric device to form a hermetic seal between the aluminum can and the plastic plug.

It should be understood that where a particular material or plastic is specified other materials are plastics which are known to be substantially interchangeable or to perform similar functions could be used.

It is understood that the invention is not limited to the particular construction and arrangement of parts herein illustrated and described, but embraces all such modified forms thereof as come within the scope of the following claims.

We claim:

1. An initiator and gas generator, comprising:

a circuit board which is substantially rectangular in plan form, having a long dimension and a short dimension, and a first trace extends along the long dimension of the circuit board, from a lead end, to a hot-wire end and a second trace substantially parallel to the first trace extends along the long dimension of the circuit board, from the lead end, to the hot-wire end;

wherein the hot-wire end is divided into two parts by a slot between the first trace and the second trace, the first trace and the second trace forming solder pads on either side of the slot;

a first electrical power connection connected to the first trace at the lead end;

a second electrical power connection connected to the second trace at the lead end;

a hot-wire resistor having a surface on which a resistor surface deposit is formed, the hot-wire resistor connected between the first trace and the second trace at the hot-wire end of the circuit board;

wherein the hot-wire resistor extends across the slot and the hot-wire resistor is positioned so that the surface on which the resistor surface deposit is formed faces the firs trace and the second trace;

a means for suppressing high voltage connected between the first trace and the second trace and positioned between the lead end, and the hot-wire end of the circuit board;

a ferrite core surrounding the first electrical power connection and the second electrical power connection, and positioned adjacent the circuit board;

a molded plastic plug, wherein within the molded plastic plug are the ferrite core, the lead end of the circuit board and the means for suppressing high voltage, the molded plastic having portions defining a sealing surface;

a quantity of initiation compound coating the hot-wire resistor; and a can containing a quantity of gas generating granules, wherein the hot-wire end of the circuit board and the hot-wire resistor are located within the can, and the can is hermetically sealed to the molded plastic plug at the sealing surface.

2. The initiator and gas generator of claim 1 wherein the can is constructed of dead soft low alloy aluminum.

3. The initiator and gas generator, of claim 1 wherein the quantity of initiation compound is primarily comprised of zirconium potassium perchlorate.

4. The initiator and gas generator, of claim 1 wherein the initiation compound is a mixture of zirconium potassium perchlorate and an elastomer.

5. The initiator and gas generator, of claim 1 wherein the means for suppressing high voltage is a zener diode.

6. The initiator and gas generator, of claim 1 wherein the molded plastic plug is constructed of glass filled nylon 6,6.

7. A initiator and gas generator, comprising:

a plastic plug;

a ferrite core contained within the plastic plug;

two conductive means extending through the ferrite core, and through the plastic plug;

a means for suppressing high voltages applied to the two conductive means, the means for suppressing high voltages extending between the two conductive means, and the means for suppressing high voltage being contained within the plastic plug;

portions of the two conductive means extending outwardly from the plastic plug on a circuit board, the circuit board being divided into two parts by a slot between the two conductive means;

a resistor having a surface on which is formed a nichrome or tantalum nitride surface deposit, the surface facing the conductive means, the resistor connected across said slot and said portions of the two conductive means;

a quantity of initiation compound positioned in intimate contact with the resistor; and a can containing a quantity of gas generating compound, the can being hermetically sealed to the plastic plug and containing between the plastic plug and the can the resistor, so that when the resistor is heated by an electrical current, the quantity of initiation compound is ignited which in turn ignites the quantity of gas generating compound within the can.

8. The initiator and gas generator of claim 7 wherein the can is constructed of dead soft low alloy aluminum.

9. The initiator and gas generator of claim 7 wherein the quantity of initiation compound is primarily comprised of zirconium potassium perchlorate.

10. The initiator and gas generator of claim 7 wherein the initiation compound is a mixture of zirconium potassium perchlorate and an elastomer.

11. The initiator and gas generator of claim 7 wherein the means for suppressing high voltage is a zener diode.

12. The initiator and gas generator of claim 7 wherein the plastic plug is constructed of glass filled nylon 6,6.

13. A method of manufacturing an initiator and gas generator comprising the steps of:

constructing a circuit board having two conductive traces, and a slot between a first portion of each of the two conductive traces on a first end of the circuit board;

soldering a wire to each trace on the circuit board at a second end;

positioning a ferrite core over the wires and close to the second end of the circuit board;

mounting an electrostatic discharge suppression device across the conductive traces;

positioning the circuit board, the suppression device and the ferrite core in a mold cavity, so that the first end of the circuit board and the slot between the traces and each of the portions of the two conductive traces extend from the mold cavity;

filling the mold cavity to form a plug with the circuit board first end, the slot and the two conductive traces first portions extending from the plug;

mounting a bridge resistor having a surface on which a resistor surface deposit is formed across the two conductive traces first portions which extend from the plug, and;

forming an initiation charge over the bridge resistor, the slot and the first end of the circuit board;

loading gas generating granules into a can; and affixing the can to the plug so that the initiation charge, when ignited by passing an electrical current through the resistor, the gas generating granules are ignited.

14. The method of claim 13 wherein the step of forming the initiation charge over the bridge resistor further comprises the steps of:

coating the bridge resistor with a mixture of zirconium potassium perchlorate, and an elastomer, the mixture being dissolved in a solvent to form a liquid so that when the bridge resistor is dipped into the liquid a layer of zirconium potassium perchlorate is formed over the resistor;

drying the mixture of zirconium potassium perchlorate and elastomer to form the initiation charge;

overcoating the mixture of zirconium potassium perchlorate and elastomer with a mixture of nitrocellulose dissolved in a solvent, to form a varnish which is resistant to moisture; and drying the nitrocellulose layer.

* * * * *